US005301750A

United States Patent [19]

Watkins

[11] Patent Number: 5,301,750

[45] Date of Patent: Apr. 12, 1994

[54] WELLHEAD APPARATUS

[75] Inventor: Bruce J. Watkins, Houston, Tex.

[73] Assignee: Dril-Quip, Inc., Houston, Tex.

[21] Appl. No.: 7,334

[22] Filed: Jan. 21, 1993

[51] Int. Cl.[5] ..... E21B 33/04

[52] U.S. Cl. ..... 166/208; 166/217; 285/145

[58] Field of Search ..... 166/208, 217, 277, 382; 185/145, 144, 141

[56] References Cited

U.S. PATENT DOCUMENTS

| | | | |
|---|---|---|---|
| 1,389,920 | 9/1921 | Weaver et al. | 285/145 X |
| 3,011,558 | 12/1961 | Conrad | 166/212 |
| 3,076,245 | 2/1963 | Acker | 285/145 X |
| 3,090,640 | 5/1963 | Otteman et al. | 285/145 X |
| 3,098,525 | 7/1963 | Haeber | 166/66.5 |
| 3,206,227 | 9/1965 | Todd | 285/3 |
| 3,468,559 | 9/1969 | Ahlstone | 285/18 |
| 3,977,473 | 8/1976 | Page, Jr. | 166/217 X |
| 4,067,388 | 1/1978 | Mouret et al. | 166/208 |
| 4,249,601 | 2/1981 | White | 166/208 |
| 4,582,133 | 4/1986 | Tambs | 166/77.5 |
| 4,691,781 | 9/1987 | Gano | 166/368 |
| 4,823,871 | 4/1989 | McEver et al. | 166/182 |
| 4,848,462 | 7/1989 | Allwin | 166/208 |
| 4,949,786 | 8/1990 | Eckert et al. | 166/208 |
| 4,982,795 | 1/1991 | King | 166/382 |
| 5,222,555 | 6/1993 | Bridges | 166/208 |

FOREIGN PATENT DOCUMENTS 0368515 10/1989 European Pat. Off. .

*Primary Examiner*—Hoang C. Dang

*Attorney, Agent, or Firm*—Vaden, Eickenroht, Thompson, Boulware & Feather

[57] ABSTRACT

There is disclosed wellhead apparatus for use in suspending a pipe string within the bore of a housing of the wellhead. The apparatus includes a slip bowl landed on a seat in the bore and a slip assembly supported within the slip bowl in a retracted position which permits the bowl and slip assembly to be lowered into landed position within an annular space between the pipe string and bore of the housing by a series of elongate rods extending within the annular space and adapted, upon rotation in one direction, to force the slip assembly downwardly and inwardly into engagement with the pipe string, and thereby suspend the weight of the pipe string from the slip assembly, and upon rotation in the opposite direction, to permit them to be released from the slip assembly and removed from within the annular space.

4 Claims, 3 Drawing Sheets

WELLHEAD APPARATUS

This invention relates generally to wellhead apparatus for use in suspending a pipe string such as well casing within the bore of a housing of the wellhead. More particularly, it relates to improvements in apparatus of this type wherein the pipe string is suspended by means of a slip assembly which is received within a bowl for lowering with the bowl through an annular space between the housing bore and pipe string into a landed position on a seat in the bore and then caused to slide downwardly and inwardly tapered in the bowl for wedging into gripping engagement with the pipe string.

Pipe strings are routinely supported by means of a solid or mandrel type hanger connected to their upper ends for landing on a seat in the bore. However, due to emergency situations, such as a stuck pipe string, it may not be possible to lower the string to full depth. In this case, adjacent sections of the housing must be disconnected intermediate its upper and lower ends to permit a slip assembly to be lowered through the annular space between the housing and pipe string into a position to grip the string below its upper end. The portion of the string above the slips is then cut away and a seal assembly installed above the slips and the adjacent housing sections then reconnected.

However, wellhead apparatus installed on many wells have so-called "unitized" housings mounted substantial distances below the rig floor, whereby it would be time-consuming and dangerous to obtain access to its bore in the manner described. Also, disconnecting a portion of the wellhead above the housing might be a violation of government regulations. Furthermore, the pipe string would normally include one or more couplings between the rig floor and wellhead over which the slip assembly might not pass.

U.S. Pat. No. 4,982,795 shows wellhead apparatus which is intended to permit a slip assembly to be so installed as to suspend the pipe string in this type of situation without having to disconnect adjacent sections of the wellhead housing. Thus, it includes a slip assembly which is received within a bowl for lowering therewith through the annular space between the housing bore and pipe string. When so lowered, the assembly is in expanded position to permit it to pass over the couplings, and, upon landing of the bowl, is forced downwardly along a tapered seat in the bowl to wedge it into a contracted position to grip and thereby permit the string to be suspended therefrom.

For this purpose, and as shown and described in such patent, the apparatus includes a carrier above the bowl to receive the upper end of the slip assembly and shear pins releasably connecting the slip assembly to the carrier and the carrier to the bowl. The apparatus further includes a tool having a first tubular member threadably connected to the carrier for lowering it and the slip assembly through the annular space and into the seat in the housing bore, as well as a second member which is vertically shiftable with respect to the first member between an upper position to dispose its lower end above the slip assembly and a lower position in which it forces the assembly down to shear the pin connecting it to the carrier and cause it to slide downwardly along the inner surface of the bowl into gripping engagement with the pipe string.

More particularly, the second tubular member of the tool is moved between its upper and lower positions by hydraulic fluid from a source above the housing which is selectively supplied to and exhausted from a pressure chamber formed between the members. Thus, when the pipe string has been suspended from the slip assembly the pressure of the hydraulic fluid is increased to apply a further force to the first member in order to shear the pin connecting the carrier to the bowl, whereby the carrier may be raised with the tool for removal from the housing bore.

As will be understood, this apparatus is of complex construction and expensive to manufacture. Also, the operation of the tool is subject to malfunction due to loss of hydraulic fluid. Still further, when the assembly is a substantial depth within the housing bore, there is no easy way to determine whether or not the slip assembly has been fully lowered into wedging engagement with the pipe string.

It is therefore the primary object to provide apparatus of this type which is of simpler construction and thus less expensive to manufacture.

More particularly, it relates to such apparatus which enables the slip assembly to be lowered without reliance on hydraulic fluid and which provides a clear indication to the operator at the upper end of the housing as to the location of the slip assembly.

These and other objects are accomplished, in accordance with the illustrated embodiment of the invention, by wellhead apparatus which includes, as in the apparatus above described, a bowl lowerable into the bore of a wellhead housing and having a shoulder for landing on a seat therein and a bore therethrough with a downwardly and inwardly tapered seat about the bore on which a circumferentially expandable and contractible slip assembly is supported. Thus, the slip assembly is slidable downwardly and inwardly over the seat in the bowl between an outer position in which the teeth are retracted to permit the bowl and the assembly to be lowered within the annular space between the housing bore and a pipe string to be suspended within the housing and an inner position in which the teeth are wedged into gripping engagement with the string.

However, in accordance with the novel aspects of the invention, a series of rods are extendible through the upper end of the housing bore and threadedly connectible at their lower ends to the bowl for lowering the bowl and slip assembly into landed position in the bore, the rods being rotatable in one direction, when the bowl is so landed, so as to force the slip assembly down from its outer to its inner position, and being rotatable in the other direction, when the slip assembly is so lowered, to release the rods from threaded connection to the bowl and permit their removal from the housing bore. Thus, the apparatus of this invention requires neither the slip carrier nor the hydraulically operated tool of the prior apparatus, much less the shearable connections between the tool and carrier and between the carrier and bowl. As a result, it is much less complicated and expensive to manufacture and more reliable in operation. In addition, the upper ends of the rods permits the operator to determine from the upper end of the housing whether or not the slip assembly is fully lowered.

In the preferred and illustrated embodiment the slip assembly comprises a normally expanded C-ring. As also illustrated, the lower threaded ends of the rods are received through threaded holes in the upper end of the bowl in position to engage the upper end of the slip assembly as the rods are lowered through the holes.

In the drawings, wherein like references are used throughout to design like parts:

Figure 2:
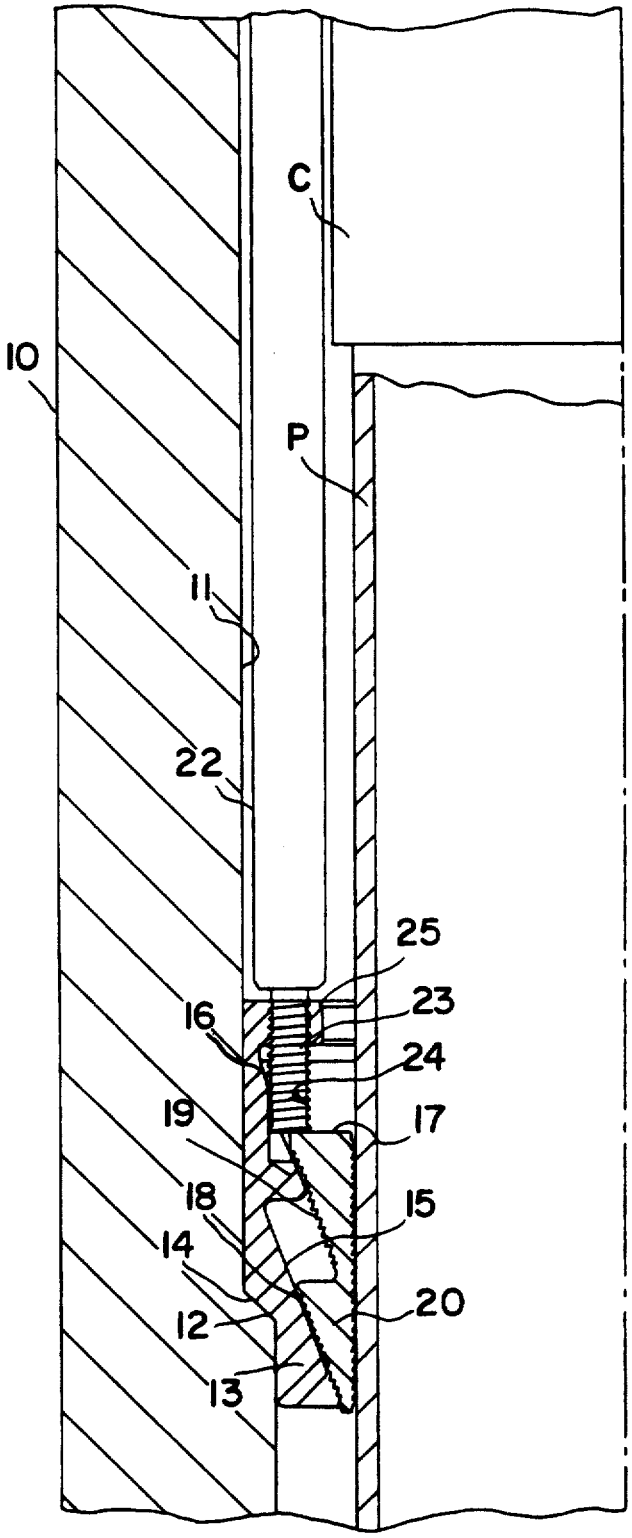
FIG. 2 is a half-sectional view similar to that of FIG. 1, but upon rotating of the rods in one direction to lower the slip assembly in the bowl and cause teeth on its inner side to engage the pipe string so that it may be suspended therefrom.
Figure 4:
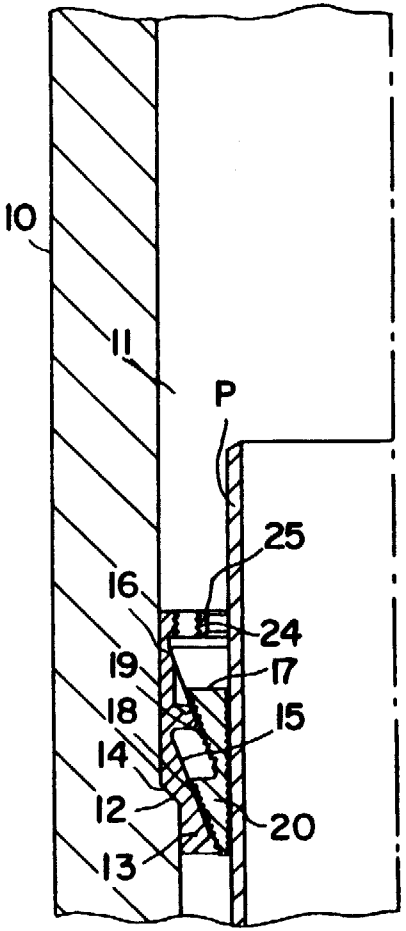
Figure 3:
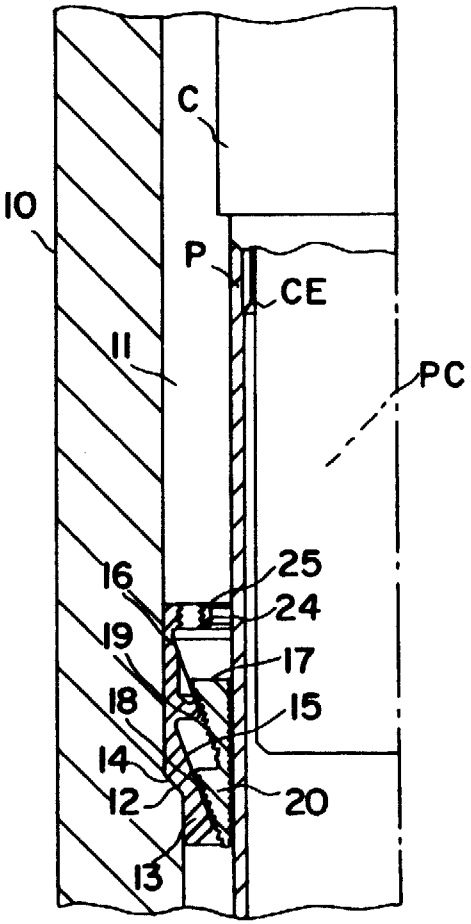

FIG. 3 is a view similar to FIG. 2, but upon removal of the rods from the slip bowl and the annular space between the pipe string and bore of the housing, and upon lowering of a cutter into the pipe string for cutting the string above the slip assembly; and FIG. 4 is another view similar to FIG. 3, but upon cutting of the pipe string, raising of cutter from the bore, and formation of a bevel on the upper edge of the cut string.

With reference now to the details of the above described drawings, a housing indicated in its entirety by reference character 10 is installed as part of a wellhead and has a bore 11 therethrough above an upwardly facing seat 12. A pipe string P extends downwardly through the bore in position to be suspended from the housing in a manner to be described.

The apparatus for so suspending the pipe string includes a bowl 13 having a shoulder 14 landed on the seat 12 and downwardly and inwardly tapered surfaces 15 and 16 about its inner side, and a slip assembly 17 received within and supported on the bowl which has outer, downwardly and inwardly tapering surfaces 18 and 19 conforming to the inner surfaces 15 and 16 of the bowl. In the retracted position of the slip assembly shown in FIG. 1, its inner surface, which has teeth 20 formed thereon, is spaced outwardly from the pipe string a distance somewhat greater than the maximum diameter of the pipe string, which, as shown, is the coupling C.

Figure 1:
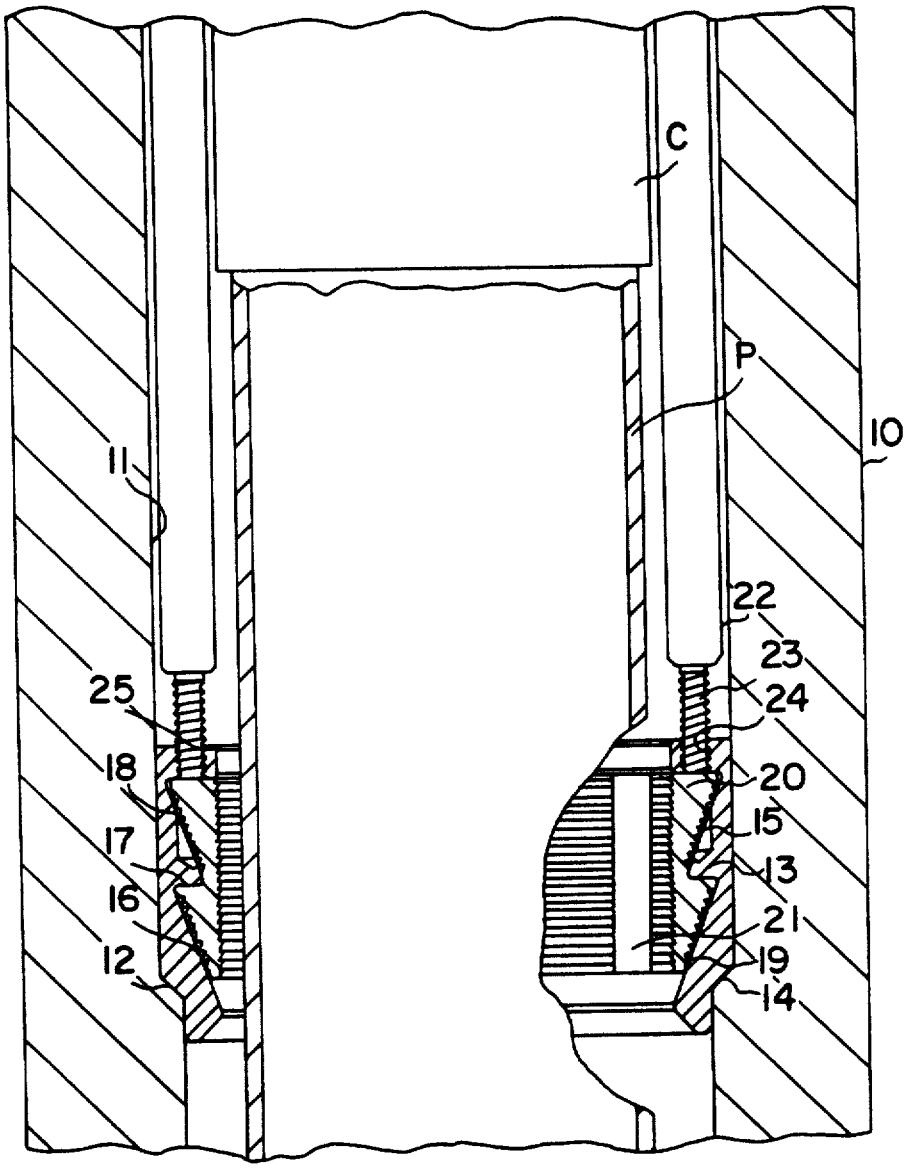
FIG. 1 is a vertical sectional view of wellhead apparatus in which the bowl and retracted slip assembly have been lowered by rods within the annular space between the bore of a wellhead housing and a pipe string extending within the bore so as to land the bowl on a seat in the housing.

As shown in FIG. 1, the slip assembly 20 is split at 21 about its circumference and of such construction that it normally assumes its retracted position shown in FIG. 1. More particularly, this split 21 permits the slip assembly to be forced to a contracted position, as shown in FIGS. 2, 3, and 4, in which the teeth on its inner side bite into the pipe string so as to permit the weight of the string to be suspended from the housing. Thus, the pipe string is suspended in tension prior to setting the slips, so that, when the slips are set, the weight of the string may be lowered onto the slips.

As previously described, and in accordance with the novel aspects of the present invention, the bowl, and thus the slip assembly supported therefrom, are adapted to be lowered through the annular space and onto the seat in the bore of the housing by means of a series of circumferentially spaced apart rods 22. Thus, as shown, the lower ends 23 of the rods are threadedly received in threaded holes 24 through an upper flange on the bowl 13 above the slip assembly supported from the bowl. As shown in FIG. 1, the rods occupy an upper position to permit the slip assembly to assume its retracted position.

However, upon landing of the bowl, the rods may be rotated in a first direction so as to lower their threaded lower ends and thus force the slip assembly to move downwardly and inwardly along the tapered surfaces 15 and 16 into wedging engagement with the pipe string, as shown in FIG. 2. As previously mentioned, at this time, the weight of the pipe string may be lowered onto the slips so that the latter will, through the bowl, suspend the weight of the pipe string from the housing.

At this time, the rods may be rotated in the opposite direction to cause their threaded ends to move out of the threaded holes 24 in the flange 25 at the upper end of the slip bowl and then raised from within the annular space between the pipe string and bore of the housing. The slip assembly will, of course, remain in its lower contracted position due to the fact that the weight of the pipe string is suspended therefrom.

With the pipe string so suspended, a pipe cutter Pc may be lowered into the pipe string, as shown in FIG. 3, to dispose its cutting edge CE in position to cut the pipe string above the slip assembly. When the pipe string has been cut, its upper cut end is lifted with the cutter PC from the bore of the housing.

At this time, a dressing tool may be lowered through the bore of the housing to a position for preparing the upper end of the housing for cooperation with a seal assembly or the like to be later installed in the annular space above the slip bowl.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Wellhead apparatus comprising a housing having a bore therethrough and an upwardly facing seat in the bore, a bowl lowerable into the bore of the housing and having a shoulder for landing on the seat therein and a bore therethrough with a downwardly and inwardly tapered seat about the bore, a circumferentially expandible and contractible slip assembly having teeth about its inner side and received within the bowl, said assembly having a downwardly and inwardly tapered outer side slidable downwardly and inwardly over the seat in the bowl between an outer position in which the teeth are retracted to permit the bowl and the assembly to be lowered within an annular space between the housing bore and a pipe string to be suspended within the housing and an inner position in which the teeth are wedged into gripping engagement with the string, and a series of rods extendible through the upper end of the housing bore and threadedly connectible at their lower ends to the bowl for lowering the bowl into landed position in the bore, said rods being rotatable in one direction, when the bowl is so landed, so as to force the slip assembly downwardly from its outer to its inner position, and being rotatable in the other direction, when the slip assembly is in its inner position to suspend the weight of the pipe string therefrom, in order to release the rods from threaded connection to the bowl and thereby permit their removal from the housing bore.

2. Wellhead apparatus as described in claim 1, wherein the slip assembly comprises a normally expanded C-ring.

3. Wellhead apparatus as described in claim 1, wherein the lower threaded ends of the rods are received through threaded holes in the upper end of the bowl in position to engage the upper end of the slip assembly as the rods are lowered through the holes.

4. Wellhead apparatus as described in claim 1, wherein the teeth of the slip assembly, when retracted, are free to move downwardly past collars or other enlargements of the pipe string.

* * * * *